US005207269A

United States Patent [19]

Heestand et al.

[11] Patent Number: 5,207,269

[45] Date of Patent: May 4, 1993

[54] PORTABLE DEVICE AND METHOD FOR ADJUSTING SLAB CASTERS

[75] Inventors: Kenneth W. Heestand, Salem, Ohio; Ronald S. Cretella, Cranberry Twp., Butler County, Pa.

[73] Assignee: Westinghouse Electric Corp., Pittsburgh, Pa.

[21] Appl. No.: 749,792

[22] Filed: Aug. 26, 1991

[51] Int. Cl.[5] ..... B22D 11/16

[52] U.S. Cl. ..... 164/491; 81/57.13; 81/57.41; 164/436

[58] Field of Search ..... 164/418, 436, 412, 491; 81/57.11, 57.13, 57.25, 57.3, 57.35, 57.41

[56] References Cited

U.S. PATENT DOCUMENTS

| | | | |
|---|---|---|---|
| 2,558,407 | 6/1951 | Woodmansee | 81/57.25 |
| 4,202,397 | 5/1980 | Hlinka et al. . | |
| 4,214,623 | 7/1980 | Jaenson . | |
| 4,246,812 | 1/1981 | Gladwin et al. . | |
| 4,255,863 | 3/1981 | Lazzaretti . | |
| 4,351,383 | 9/1982 | Gladwin . | |
| 4,383,571 | 5/1983 | Frantz et al. . | |

FOREIGN PATENT DOCUMENTS

| | | | |
|---|---|---|---|
| 62-158832 | 7/1987 | Japan | 164/412 |
| 476156 | 11/1975 | U.S.S.R. | 81/57.41 |
| 564953 | 7/1977 | U.S.S.R. | 81/57.41 |
| 1004089 | 3/1983 | U.S.S.R. | 81/57.11 |
| 1366381 | 1/1988 | U.S.S.R. | 81/57.11 |
| 2064394A | 6/1981 | United Kingdom | 81/57.41 |

OTHER PUBLICATIONS

Operations and Maintenance Manual for 32" to 50" Electronic Mold System, Published by Gladwin Engineering, Jun. 1984.

*Primary Examiner*—J. Reed Batten, Jr.
*Attorney, Agent, or Firm*—G. H. Telfer

[57] ABSTRACT

A portable mold adjusting device allows for relatively precisely adjusting the mold cavity size of a slab caster mold during casting. The portable mold adjusting device includes a dolly to facilitate transport of the device to molds requiring an adjustment. A mechanical drive is secured to the dolly. A free end of the drive is provided with a coupling adapted to be coupled to the adjustment mechanism on an adjustable slab casting mold. The other end of the mechanical drive is directly coupled to a reversible electric motor. The mechanical drive is encoded to allow for relatively precise positioning of the adjustable mold walls.

17 Claims, 3 Drawing Sheets

PORTABLE DEVICE AND METHOD FOR ADJUSTING SLAB CASTERS

BACKGROUND OF THE INVENTION

1. Field of the Invention

The present invention relates to a device for use in a continuous slab casting process and more particularly to a portable mold adjusting device for relatively precisely adjusting the mold cavity size of slab casting molds both during casting and between casts.

2. Description of the Prior Art

The continuous casting process involves a continuous flow of molten steel from a ladle or tundish into a generally box-shaped casting mold to form a slab. Since the slabs are generally cast with a uniform thickness but various widths, for example, 24 to 50 inches, the slab mold is formed with a pair of stationary mold walls and a pair of adjustable mold walls. More specifically, the stationary mold walls are generally rigidly mounted and spaced apart a predetermined distance to form slabs having a uniform thickness between 4 and 12 inches. The adjustable mold walls are disposed between the rigidly mounted mold walls intermediate the ends to allow the Width of the slabs to be varied, for example, between 24 and 50 inches.

The mold walls are typically formed with heavy fabricated steel with inner facings usually of copper. Cooling channels are generally disposed between the inner facings and the heavy fabricated steel walls. Cooling water is circulated through the cooling channels to remove heat from the molten steel to initiate solidification of the molten steel within the mold.

Slab casting molds have heretofore been provided with integral means for adjusting the slab widths. More specifically, various devices including hydraulic cylinders have been mechanically linked to the adjustable mold walls to move the adjustable mold walls either inwardly or outwardly to vary the width of the slab. Due to the relative inaccuracy of such known adjustment means, the slab widths are generally adjusted between casts and have not generally been known to be adjusted during the casting process only between casts. This, in turn, increases the production time to produce slabs with various widths.

Such slab casting molds with integral adjustment means generally increase the cost of the molds and have been known to result in increased cost to the end user. More specifically, many steel mills have been known to operate a plurality of continuous casting lines. Thus, in such situations, since each slab casting mold is provided with integral adjustment means, the overall cost is relatively high.

Another problem with such slab casting molds is that the integral adjustment means have been known to require a significant amount of maintenance. Such maintenance time results in downtime of the caster resulting in lost profits.

SUMMARY OF THE INVENTION

It is an object of the present invention to solve the problems associated with the prior art.

It is a further object of the present invention to reduce the cost of slab casting molds.

It is yet a further object of the present invention to reduce the production time to produce slabs with various widths.

It is yet a further object of the present invention to provide a device that allows the mold to be adjusted during casting.

It is yet a further object of the present invention to reduce the downtime of slab casting molds.

It is yet a further object of the present invention to provide an adjustment device for adjusting slab casting molds relatively precisely.

It is yet a further object of the present invention to provide a portable mold adjusting device that can be used on a plurality of casting molds.

Briefly, the present invention relates to a portable mold adjusting device for relatively precisely adjusting the mold cavity size of a slab caster mold during casting. The portable mold adjusting device includes a dolly to facilitate transport of the device to molds requiring adjustment. A mechanical drive is secured to the dolly. A free end of the drive is provided with a socket adapted to be coupled to the adjustment mechanism on an adjustable slab casting mold. The other end of the mechanical drive is coupled to an electric motor. The mechanical drive is encoded to allow for relatively precise positioning of the adjustable mold walls.

DESCRIPTION OF THE DRAWING

These and other objects and advantages of the present invention will become readily apparent upon consideration of the following detailed description and attached drawing, wherein.

FIG. is a plan view of an adjustable continuous slab mold illustrating the portable adjusting device in accordance with the present invention coupled thereto.

DETAILED DESCRIPTION OF THE DRAWING

Figure 1:
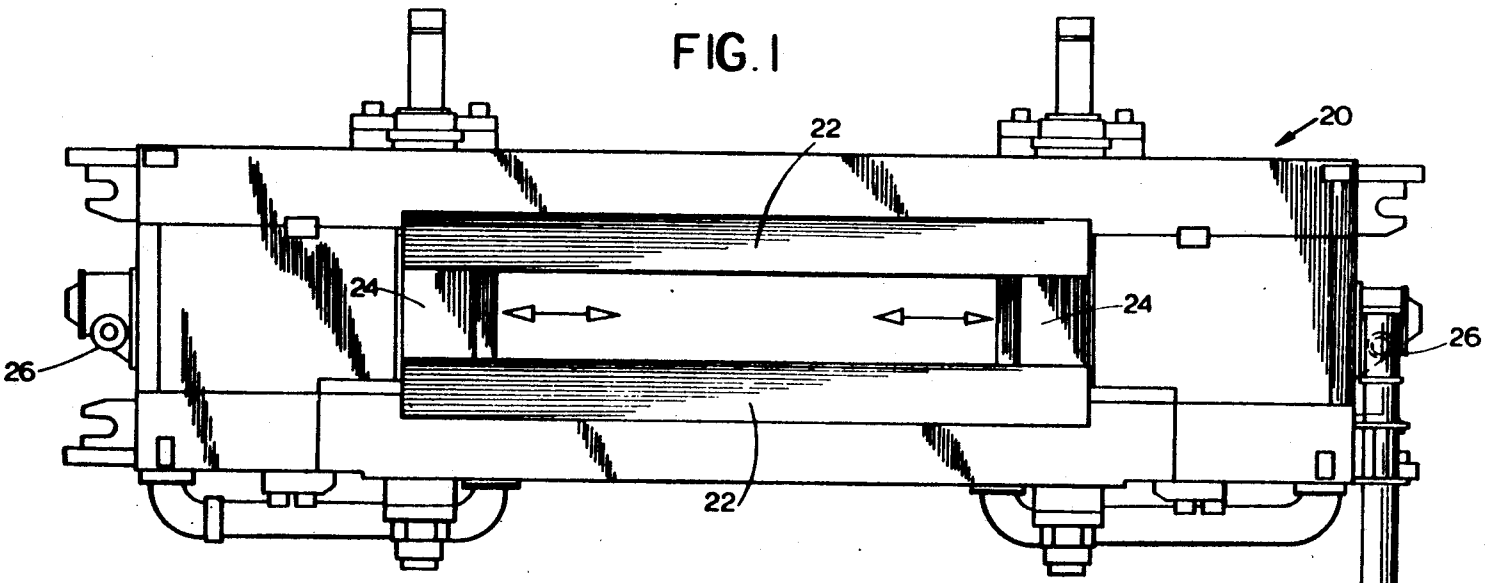

An adjustable slab mold for use in a continuous casting process is illustrated in FIG. 1 and generally identified with the reference numeral 20. The slab mold 20 includes a pair of elongated mold walls 22 rigidly mounted relative to the mold 20 and spaced apart a predetermined distance to provide slabs of a uniform thickness, for example, between 4 inches and 12 inches. A pair of relatively shorter mold walls 24 are disposed between the elongated mold walls 22 intermediate the ends. Each of the relatively shorter mold walls 24 are adapted to be moved inwardly and outwardly to vary the width of a slab between 24 and 50 inches, as indicated by the arrows in FIG. 1.

As is known in the art, such slab molds 20 are normally provided with integral automatic adjustment devices (not shown) to enable the mold walls 24 to be moved inwardly and outwardly to vary the mold cavity size. An example of such a mold 20 with an integral adjustment device is available from Gladwin Engineering, East Palatine, Ohio and described in *OPERATIONS AND MAINTENANCE MANUAL FOR* 32" *TO* 80" *ELECTRONIC MOLD SYSTEM (IMPROVED GEARBOX MOLD) AT BETHLEHEM STEEL BURNS HARBOR PLANT NUMBER* 1 *CONTINUOUS SLAB CASTER,* published by Gladwin Engineering, June 1984, hereby incorporated by reference. Such molds 20 include a pair of fasteners 26, mechanically coupled to the integral adjustment device (not shown), which allows for independent displacement of each of the mold walls 24 by rotation of the respective fastener 26.

The portable mold adjusting device in accordance with the present invention, generally identified with the reference numeral 28, is adapted to be coupled to the fastener 26 to allow for external adjustment of the mold cavity size. As will be discussed in more detail below, the portable mold adjusting device 28 in accordance with the present invention is adapted to provide relatively precise positioning of the adjustable mold walls 24 to allow the slab thickness to be varied during the casting process.

Since the mold adjuster device 28 is portable, it can be used on various slab casting molds within a steel mill. Moreover, the portable mold adjusting device 28 can be used on molds 20 with integral automatic adjustment devices which are malfunctioning in order to reduce the downtime and thereby improve production time.

Figure 3:
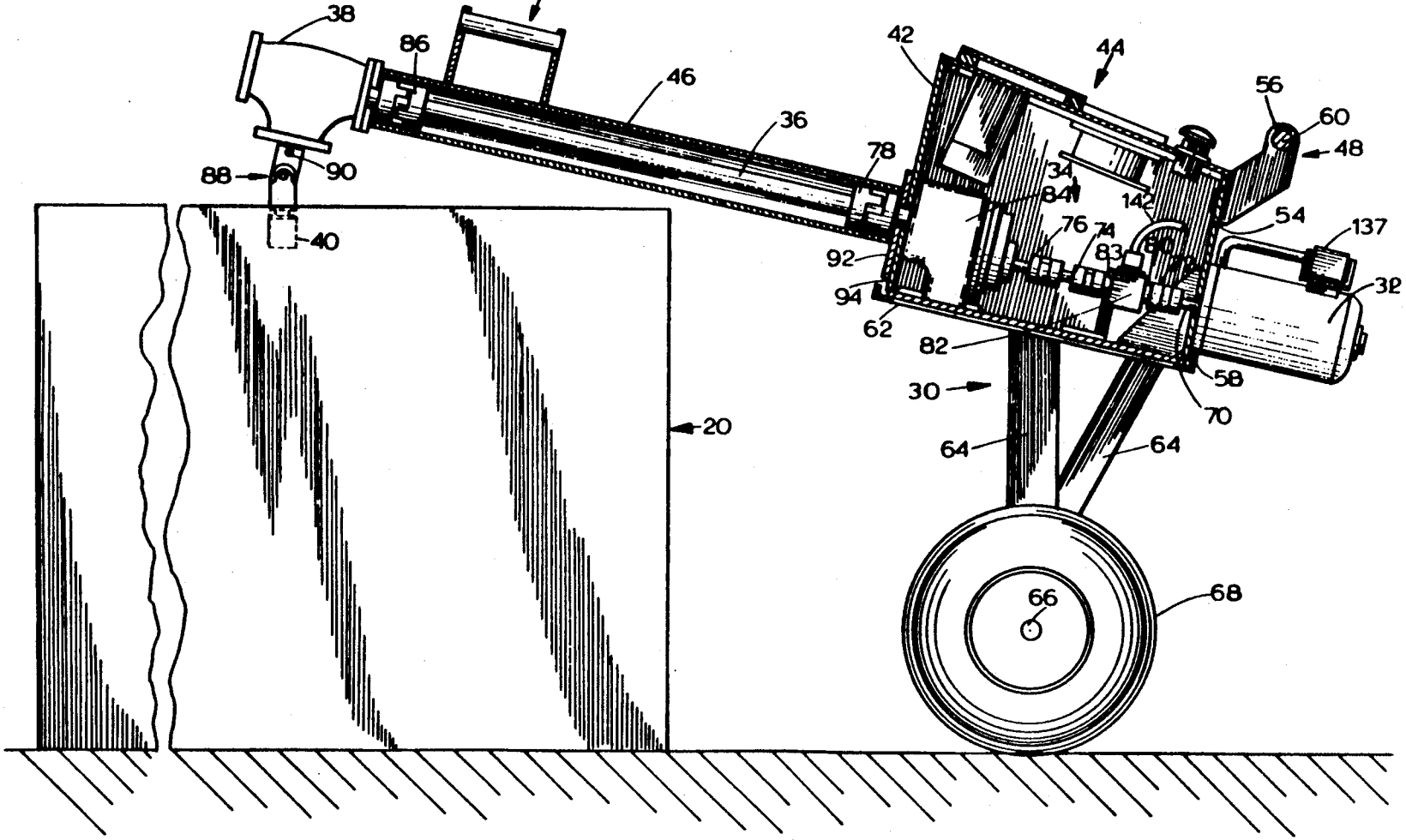
FIG. 3 is an elevational view of the portable adjusting device, partially in section, illustrating the portable adjusting device coupled to an adjustable slab casting mold.

Referring to FIG. 3, the portable mold adjuster device 28 in accordance with the present invention includes a dolly 30, an electric motor 32, a transmission, generally identified with the reference numeral 34, a driveshaft 36, a right angle drive 38 and a socket 40 adapted to receive the adjustment fasteners 26. The transmission 34 is enclosed in a housing 42 formed with a control panel 44 on the top surface. The driveshaft 36 is disposed in an elongated housing 46. The driveshaft housing 46 is adapted to be rigidly secured to the transmission housing 42.

Figure 2:
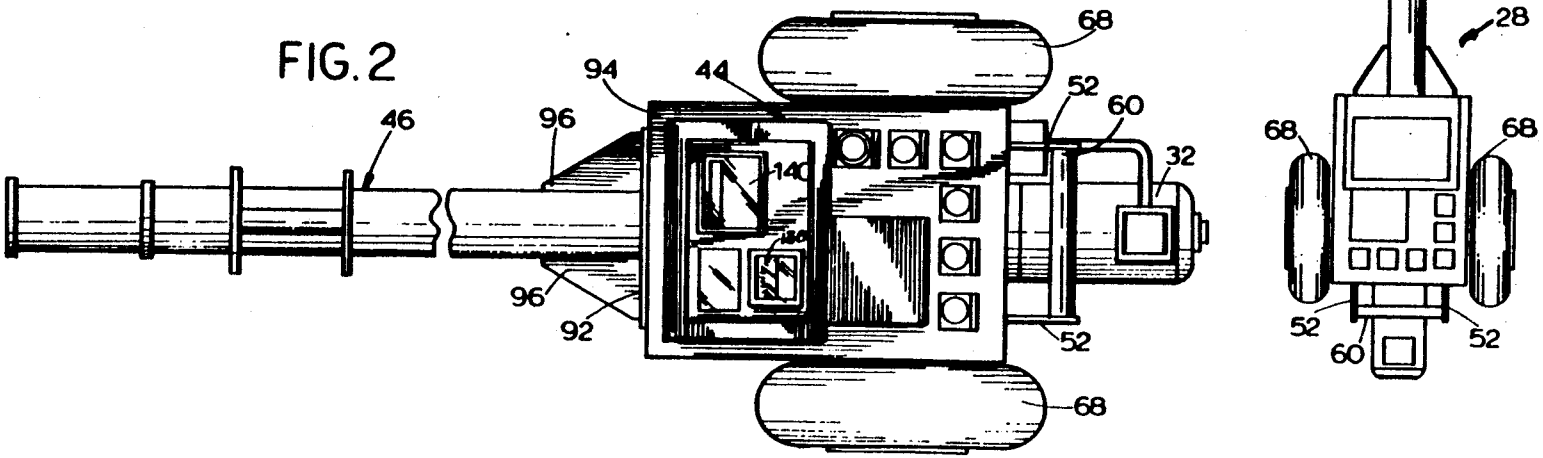
FIG. 2 is a plan view of the portable adjusting device in accordance with the present invention.

Handle assemblies 48 and 50 may be provided at each end of the portable mold adjustment device 28 to facilitate transport of the device. More specifically the handle assembly 48 may be formed from a pair of spaced apart irregular-shaped brackets 52 (FIGS. 1, 2 and 3), formed with a flat edge 54 on one end and provided with an aperture 56 in the other end. The flat edges 54 of the bracket 52 may then be disposed a predetermined distance apart on a rear surface 58 of the housing 42 and rigidly secured in place, for example, by welding. A rod 60 may then be inserted into the apertures 56 and secured in place forming the handle assembly 48. The handle assembly 50 may be formed in a similar manner and secured to the driveshaft housing 46, intermediate the end of the driveshaft 36 adjacent the right angle drive 38 as shown.

The dolly 30 allows for relatively quick and easy transport of the mold adjustment device 28. The dolly 30 includes a carrier 62, formed, for example, from four sections of angle iron, which may be, for example 1 inch by 1 inch by ⅛ inch, welded together end to end in a generally rectangular shape sized to carry the transmission housing 42—rigidly secured thereto, for example, by welding.

Two pairs of depending legs 64 may be used to form an axle support. More specifically, each pair of depending legs 64 is fastened together at one end and provided with an aperture (not shown) for receiving an axle 66. The other end of the depending legs 64 in each pair is then rigidly secured to the carrier 62 on opposing sides, for example, by welding. A pair of transport wheels 68 may then be disposed about the axle 66 to facilitate transport.

The motor 32 is rigidly attached to the rear surface 58 of the transmission housing 42 such that its shaft 70 extends inwardly into the housing 42. One or more axial couplings 72, 74, 76 and 78 may be used to couple the motor shaft 70 to the driveshaft 36. More specifically, a first axial coupling device 72 is connected between the motor driveshaft 70 and an outwardly extending shaft 80 of a shaft encoder 82. The axial coupling devices 74 and 76 may be used to couple an extending shaft 83 from the other side of the shaft encoder 82 to the driveshaft 36. The axial coupling units 72, 74 and 76 may be, for example, as supplied by Lovejoy Corporation under Model No. L-070.

In order to reduce the speed at which the driveshaft 36 rotates relative to the motor 70 of the electric motor 32, a speed reducer 84 is provided. The speed reducer 84 is connected on one end to the motor driveshaft 70 by way of the axial coupling devices 72, 74, 76 and the shaft encoder 82. The other end of the speed reducer 84 is coupled to the driveshaft 36 by way of an axial coupling device 78. The axial coupling device 78 may be, for example, a Lovejoy Model L-099. The speed reducer 84 may be a 12.5:1 Dayton type speed reducer, for example, a Granger Model 4Z861.

Since the axis of the fasteners 26 on the mold 20 will be perpendicular generally to the axis of the driveshaft 36 when the portable mold adjustment device 28 is in position to adjust the position of the movable mold walls 24, a right angle gear drive assembly 38 is provided, which may be a McMaster-Carr Model No. 6456K24. The right angle gear drive 38 is coupled on one end to the driveshaft 36 by way of another axial coupling device 86. The axial coupling device 86 may be, for example, a Lovejoy Model L-099.

The right angle gear device 38 includes an extending shaft (not shown), adapted to be connected to a universal joint 88 formed from, for example, Lovejoy Model No. D-10B and Granger Model No. 1A932 components, by way of a pin 90. The socket 40 may then be mechanically coupled to the universal joint 88. The universal joint 88 allows the socket 40 to swivel to facilitate coupling of the socket 40 with respect to the adjustment fastener 26.

The transmission 34, which includes the coupling devices 72, 74, 76 as well as the shaft encoder 82 and the speed reducer 84, is disposed in the transmission housing 42 which is rigidly secured to the carrier 62 on the dolly 30. The housing 42 may be formed from various means, for example, from sheet metal welded together. A control panel 44 is formed on the top portion of the housing 42 to allow for control of the portable mold adjustment device 28.

The driveshaft 36 is also disposed in a housing 46, which may be tubular in shape, formed for example, from sheet metal. In order to support the weight of the driveshaft 36 as well as the right angle drive 38, a plate 92 may be rigidly secured to the front wall 94 of the housing 42, for example, by welding. The driveshaft housing 46 may then be welded to the plate 92. In order to provide additional support, gusset plates 96 (FIG. 2) may be secured between the plate 92 and the driveshaft housing 46.

Figure 4:
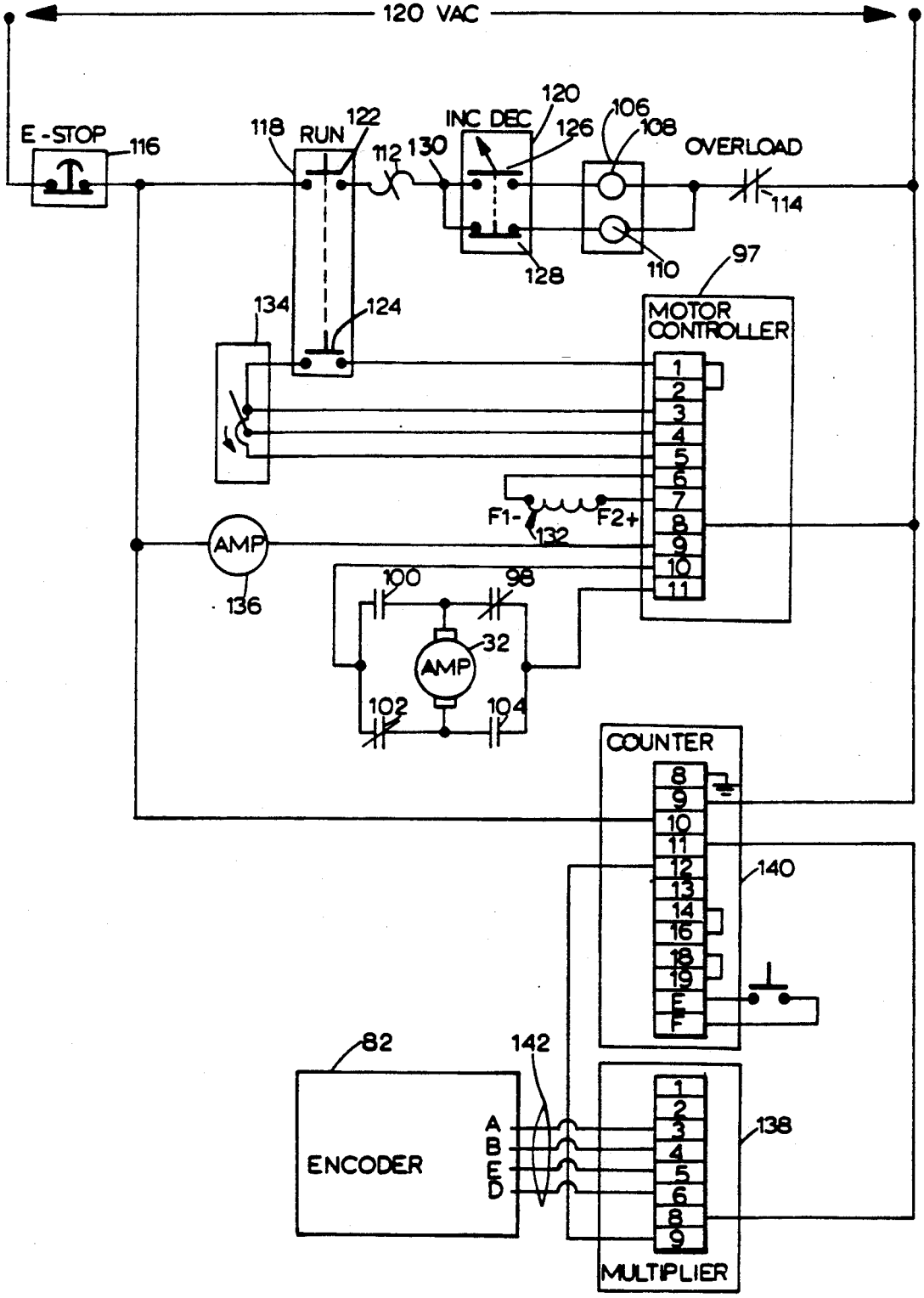
FIG. 4 is an electrical schematic diagram of the portable adjusting device in accordance with the present invention.

An important aspect of the invention relates to the electrical control of a portable mold adjusting device 28 which allows relatively precise adjustment of the adjustable mold walls 24 to allow adjustment during casting as well as between casts. The electrical control includes the electric motor 32 and a motor controller 97 (FIG. 4). The electric motor 32 may be a ⅓ horsepower DC motor, 0–1750 RPM, for example, a Baldor Model No. 7021-0472B. The motor controller 97 may be, for example, an Extron Model No. 100-10. The motor controller 97 includes an integral rectifier (not shown) for converting AC to DC.

In order to allow the direction of the motor 32 to be reversed, the motor 32 is connected to the motor controller 97 by way of four contacts 98, 100, 102 and 104, which form a portion of a four pole reversing relay 106 having coils 108 and 110; for example, Allen-Bradley Model No. 700-N400A1. As will be discussed below, the reversing relay 106 allows the polarity applied to the armature of the motor 32 to be changed in order to reverse directions of the motor 32.

The reversible relay 106 is under the control of an overload relay which includes an overload heater 112 and an overload contact 114 as well as three control switches 116, 118 and 120, all connected in series as shown in FIG. 4 across a source of electrical power, for example, 120 volts AC.

The control switch 116 is an emergency stop switch which may be a two position, push/pull type switch with a single normally closed maintained contact, for example, an Allen-Bradley Model No. 800T-FXJ604. The emergency stop switch 116 contact is connected on one end to the source of electrical power and on the other end to the contact switch 118, used as a run switch. The emergency stop switch 116 allow the entire electrical control to be disabled, for example, during emergency conditions.

The run switch 118 may be a momentary pushbutton switch with a pair of single pole, single throw normally open contacts 122 and 124, for example, an Allen-Bradley Model No. 800T-B101 pushbutton switch. The contact 122 is connected on one end in series with the emergency stop switch contact 116. The other end of the contact 122 is connected to the overload heater 112 in order to control the reversing relay 106. The contact 124 is interlocked with the motor controller 96 to energize the motor 32 whenever the pushbutton 118 is depressed.

The control switch 120 is for controlling the direction of rotation of the motor 32. The control switch 120 may be, for example, a three position selector switch, for example, an Allen-Bradley Model No. 800T-J2B with a single pole, double throw set of contacts 126 and 128. The contact 126 is connected to the coil 108 while the contact 128 is connected to the coil 110 in the reversing relay 106. A common pole 130 of the control switch 120 is connected to the overload heater 112.

As shown, the control switch 120 is in the increase position in order to increase the size of the mold cavity 20. In this position the coil 110 will be energized as long as the emergency stop switch contact 116 is closed; the overload heater 112 and overload contact 114 are closed and the run switch contacts 122 and 124 are closed. In this condition the relay contacts 98 and 102 of the reversing relay 106 will be closed causing the motor 32 to rotate in a direction to cause the adjustable mold wall 24 to move outwardly to expand the cavity size of the mold 20. When the control switch 120 is placed in the decrease position in order to decrease the mold cavity size, the coil 110 will be deenergized and the coil 108 will be energized. In this condition, the contacts 100 and 104 will be closed and apply a reverse polarity to the armature of the motor 32 to cause it to rotate in a direction in order to cause the adjustable mold walls 24 to move inwardly to decrease the mold cavity size.

The overload heater 112 and its associated contact 114 are provided to protect the motor 32 from damage due to overcurrent resulting from an overload. The overload relay contact 114 may be, for example, an Allen-Bradley Model No. 592-BOV4. The overload heater element 112, is normally selected according to the characteristics of the motor 32 may be, for example, an Allen-Bradley Model No. W41.

In operation, in order to control the motor 32, the control switch 120 is placed in the desired position depending on whether the mold cavity size is to be increased or decreased. The run pushbutton 118 is then depressed which causes the motor 32 to be energized.

The control circuitry also allows the speed of the motor 32 to be controlled. More specifically, field windings 132 of the motor 32 are connected to the motor controller 96. A speed adjustment potentiometer 134 is also connected to the motor controller 96. The speed adjustment potentiometer 134 allows the speed of the motor 32 to be varied by varying the voltage applied to the motor field winding 132. The speed adjustment potentiometer may be a 5000 ohm potentiometer, for example, an Allen-Bradley Model No. 800T-U2A.

Various options may also be provided to monitor the characteristics of the motor 32 during operation. For example, an ammeter 136 may be applied between the motor controller 96 and the source of electrical power. The ammeter 96 may be mounted on the control panel 44. It should also be understood in the art that various other options could also be included, such as a tachometer 137 (FIG. 3) and various other meters.

An important aspect of the invention relates to the ability of the electrical control circuit to relatively precisely indicate the mold cavity size to enable mold cavity adjustments during casting. The circuitry for indicating the mold cavity size includes the shaft encoder 82, a multiplier 138 and a display counter 140. The encoder 138 is a shaft encoder 82 which, for example, may be Encoder Products Model No. 716 which provides one pulse per revolution. The shaft encoder 82 is coupled to the multiplier 138 by way of an encoder cable and connector assembly 142 which may be, for example, Encoder Products Model No. CL5-10.

The output pulses from the encoder 82 are applied to the multiplier 138 which, in turn, is coupled to the display counter 140. The multiplier 138 may be, for example, an ECCI Model No. MBRM215. The display counter 140 may be a six decade counter, for example, an ECCI Model No. MBH106Z01A.

The multiplier 138 as well as the counter 140 translate output pulses from the shaft encoder 82 into inches of travel of the adjustable mold walls 24. More specifically, for the motor 32 with a 0–1750 RPM output, the output to the socket 40 with the 12.5:1 speed reducer 84 will be approximately 0–140 RPM. This, in turn, will result in one output pulse from the encoder 82 being equal to approximately 0.0017 inches of travel of the mold wall 24. Thus, when it is desired to adjust the mold cavity size, an operator can merely place the control switch 120 in the proper position for either increasing or decreasing the mold cavity size and depress the run pushbutton switch 118 and observe the output of the display counter 140 until the desired mold cavity size is observed, at which time the pushbutton switch 118 will be released. Accordingly, by providing relatively precise indication of the mold cavity size, an operator can adjust the mold cavity size during casting.

Obviously, any modifications and variations of the present invention are possible in light of the above teachings. Thus, it is to be understood that, within the scope of the appended claims, the invention may be practiced otherwise than as specifically described above.

What is claimed and desired to be secured by letters patent of the United States is:

1. A portable mold adjusting device for adjusting the mold cavity size of a slab caster mold during casting comprising:

means for supplying a source of mechanical power;

means coupled to said supplying means for transmitting said source of mechanical power to rotate a driveshaft;

a driveshaft rotatably mounted, coupled to said transmitting means;

means coupled to said driveshaft for fitting on and rotating a fastener whose rotation adjusts the cavity size of a mold;

means for carrying said supplying means, said transmitting means, said driveshaft and said rotating means which includes means for transporting said carrying means; and means for measuring the rotation of said driveshaft and monitoring change in mold cavity size resulting from the rotation.

2. A portable mold adjusting device as recited in claim 1, wherein said measuring means includes a shaft encoder.

3. A portable mold adjusting device as recited in claim 1, wherein said supplying means includes an electric motor having an output shaft.

4. A portable mold adjusting device as recited in claim 3, wherein said transmitting means includes means for coupling said output shaft to said driveshaft.

5. A portable mold adjusting device as recited in claim 4, wherein said transmitting means includes one or more axial coupling devices.

6. A portable mold adjusting device as recited in claim 3, further including means for varying the speed of said electric motor.

7. A portable mold adjusting device comprising:

means including an electric motor having an output shaft and means for measuring the rotation of said output shaft and monitoring change in mold cavity size resulting from the rotation for adjusting the mold size of a caster;

means for carrying said adjusting means;

means for allowing rolling transport of said carrying means; and means, coupled to said output shaft, for transferring the power in said output shaft about an axis generally perpendicular to said output shaft.

8. A portable mold adjusting device as recited in claim 7, wherein said transferring means includes a right angle drive.

9. A portable mold adjusting device as recited in claim 7, wherein said measuring means includes a shaft encoder.

10. A portable mold adjusting device as recited in claim 7, wherein said adjusting means includes a socket adapted to receive an adjustment fastener on an adjustable mold.

11. A portable mold adjusting device for adjusting the mold cavity size of a slab casting mold comprising:

an electric motor having an output shaft;

a driveshaft;

first coupling means for coupling said driveshaft to said output shaft;

means for adjusting said mold cavity size;

second coupling means for coupling said adjusting means to said driveshaft;

means for carrying said electric motor, said driveshaft, said adjusting means and said first and second coupling means;

means for providing rolling support for said carrying means;

control means for said electric motor comprising means for speed control and means for operating the motor in a desired direction of rotation in order to increase or decrease mold size cavity size; and means for indicating the mold size cavity change whereby operation of the control means and observance of the means for a driveshaft rotatably mounted, coupled to said transmitting means;

means coupled to said driveshaft for fitting on and rotating a fastener whose rotation adjusts the cavity size of a mold;

means for carrying said supplying means, said transmitting means, said driveshaft and said rotating means which includes means for transporting said carrying means; and means for measuring the rotation of said driveshaft and monitoring change in mold cavity size resulting from the rotation.

12. A mold adjusting device as recited in claim 11, wherein said first coupling means includes means for axially coupling said output shaft to said driveshaft.

13. A mold adjusting device as recited in claim 12, wherein said first coupling means further includes means for reducing the speed of said output shaft.

14. A mold adjusting device as recited in claim 11, wherein said second coupling means includes means for coupling said adjusting means generally perpendicular to said driveshaft.

15. A mold adjusting device as recited in claim 11, wherein said adjusting means includes a socket for receiving a fastener of a predetermined size on an adjustable mold.

16. A portable mold device as recited in claim 15, further including means for pivotally mounting said socket.

17. A method of adjusting mold cavity size of casting molds using a portable mold adjusting device in accordance with claim 11 and comprising:

moving the mold adjusting device to a location proximate a casting mold having a movable mold wall and means for causing displacement of the mold wall;

coupling the means for adjusting mold cavity size of the portable mold adjusting device to the means for causing displacement of the mold wall of the casting wall;

energizing the electric motor and control means of the portable mold adjusting device for operation at a desired motor speed and direction of rotation;

observing the means for indicating the mold cavity size until the desired mold cavity size is observed.

* * * * *